US008192909B2

(12) United States Patent
Jin et al.

(10) Patent No.: US 8,192,909 B2
(45) Date of Patent: Jun. 5, 2012

(54) CHEMICALLY PREPARED POROUS TONER

(75) Inventors: Xin Jin, Pittsford, NY (US); Jason Morgan, Fairport, NY (US); Charles T. Havens, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 1422 days.

(21) Appl. No.: 11/313,612

(22) Filed: Dec. 21, 2005

(65) Prior Publication Data

US 2007/0141501 A1 Jun. 21, 2007

(51) Int. Cl.
*G03G 9/08* (2006.01)

(52) U.S. Cl. ..... 430/111.4; 430/109.3; 430/137.1; 430/137.15; 430/137.17

(58) Field of Classification Search ..... 430/109.3, 430/111.4, 137.1, 137.15, 137.17
See application file for complete search history.

(56) References Cited

U.S. PATENT DOCUMENTS

| | | | | |
|---|---|---|---|---|
| 3,979,342 | A | 9/1976 | Baidins et al. | |
| 4,254,201 | A | 3/1981 | Sawai et al. | |
| 4,379,825 | A | 4/1983 | Mitushashi | |
| 4,489,174 | A | 12/1984 | Karickhoff | |
| 4,814,253 | A * | 3/1989 | Gruber et al. | 430/110.1 |
| 4,833,060 | A | 5/1989 | Nair et al. | |
| 4,910,108 | A * | 3/1990 | Tavernier et al. | 430/32 |
| 4,965,131 | A | 10/1990 | Nair et al. | |
| 5,102,765 | A * | 4/1992 | McCabe et al. | 430/108.21 |
| 5,545,504 | A * | 8/1996 | Keoshkerian et al. | 430/137.17 |
| 2003/0054280 | A1 | 3/2003 | Ishihara et al. | |
| 2005/0026064 | A1 * | 2/2005 | Sugiura et al. | 430/109.4 |
| 2006/0281834 | A1 * | 12/2006 | Lee et al. | 523/201 |
| 2008/0176157 | A1 | 7/2008 | Nair et al. | |
| 2008/0176164 | A1 | 7/2008 | Nair et al. | |
| 2008/0268363 | A1 | 10/2008 | Nair et al. | |
| 2008/0268367 | A1 | 10/2008 | Nair et al. | |

FOREIGN PATENT DOCUMENTS

| | | |
|---|---|---|
| EP | 0 686 881 | 12/1995 |
| EP | 0 826 697 | 3/1998 |
| UK | 2 072 362 | 9/1981 |
| WO | 2005/074392 | 8/2005 |

OTHER PUBLICATIONS

U.S. Appl. No. 11/870,710, filed Oct. 11, 2007, Massa et al.
U.S. Appl. No. 11/870,651, filed Oct. 11, 2007, Massa et al.

* cited by examiner

*Primary Examiner* — Mark F Huff
*Assistant Examiner* — Rachel Zhang
(74) *Attorney, Agent, or Firm* — Carl F. Ruoff; Andrew J. Anderson

(57) ABSTRACT

The present invention provides a porous toner. The porous toner has a porosity of greater that 20 percent. The toner can include vinyl polymers, copolymers of styrene monomers and polyesters. In addition a method of manufacture of the toner particles is provided.

16 Claims, 1 Drawing Sheet

CHEMICALLY PREPARED POROUS TONER

FIELD OF THE INVENTION

This invention relates to a method for the preparation of polymeric powders suitable for use as electrostatographic toner, and more particularly, to a method for the preparation of polymer particles having an elevated porosity.

BACKGROUND OF THE INVENTION

In the conventional method of making electrophotographic toner powders, a binder polymer and other ingredients, such as a pigment and a charge control agent, are melt blended on a heated roll or in an extruder. The resulting solidified blend is then ground or pulverized to form a powder. Inherent in this conventional process are certain drawbacks. For example, the binder polymer must be brittle to facilitate grinding. Improved grinding can be achieved at lower molecular weight of the polymeric binder. However, low molecular weight binders have several disadvantages; they tend to form toner/developer flakes; they promote scumming of the carrier particles that are admixed with the toner powder for electrophotographic developer compositions; their low melt elasticity increases the off-set of toner to the hot fuser rollers of the electrophotographic copying apparatus, and the glass transition temperature (Tg) of the binder polymer is difficult to control. In addition, grinding of the polymer results in a wide particle size distribution. Consequently, the yield of useful toner is lower and manufacturing cost is, therefore, higher. Also the toner fines accumulate in the developer station of the copying apparatus and adversely affect the developer life.

The preparation of toner polymer powders from a preformed polymer by the process known as "evaporative limited coalescence" offers many advantages over the conventional grinding method of producing toner particles. In this process, polymer particles having a narrow size distribution are obtained by forming a solution of a polymer in a solvent that is immiscible with water, dispersing the solution so formed in an aqueous medium containing a solid colloidal stabilizer and removing the solvent. The resultant particles are then isolated, washed and dried.

In the practice of this technique, polymer particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by mechanical shearing using rotor-stator type colloid mills, high pressure homogenizers, agitation etc.

Limited coalescence techniques of this type have been described in numerous patents pertaining to the preparation of electrostatic toner particles because such techniques typically result in the formation of polymer particles having a substantially uniform size distribution. Representative limited coalescence processes employed in toner preparation are described in U.S. Pat. Nos. 4,833,060 and 4,965,131 to Nair et al., incorporated herein by reference for all that they contain.

This technique includes the following steps: mixing a polymer material, a solvent and optionally a colorant and a charge control agent to form an organic phase; dispersing the organic phase in an aqueous phase comprising a particulate stabilizer and homogenizing the mixture; evaporating the solvent and washing and drying the resultant product.

Polymeric powders can also be prepared by emulsion and suspension polymerization techniques. In suspension polymerization, polymerization initiator and additives such as a colorant are dissolved into water-insoluble monomers, and the resulting composition is suspended under high-speed shear stirring into an aqueous solution comprising an appropriate dispersant, for example, a water-soluble polymer, an inorganic powder and a surface active agent, and the suspension is subjected to polymerization to form colored polymer particles. The solidified polymer particles are separated from the remainder of the system. Patents utilizing these techniques to prepare toner polymer particles having a narrow size distribution referred to as "limited coalescence polymerization." Several examples in numerous patents include U.S. Pat. Nos. 2,934,530; 3,615,972; 2,932,629 and 4,314,932 and are incorporated by reference herein.

There is a need to reduce the amount of toner applied to a substrate in the electrophotographic process (EP). Porous toner particles in electrophotographic process are supposed to reduce the toner mass in the image area. Simplistically, a toner particle with 50% porosity should require only half as much mass to accomplish the same imaging results. Hence, toner particles having an elevated porosity will lower the cost per page and decrease the stack height of the print as well. The application of porous toners provides a practical approach to reduce the cost of the print and improve the print quality.

An object of the present invention is to provide a toner particle with increased porosity.

SUMMARY OF THE INVENTION

The present invention provides a porous toner. The porous toner has a porosity of greater that 20 percent. The toner can include vinyl polymers, copolymers of styrene monomers and polyesters. In addition, a method of manufacture of the toner particles is provided.

DETAILED DESCRIPTION OF THE INVENTION

Figure 1A:
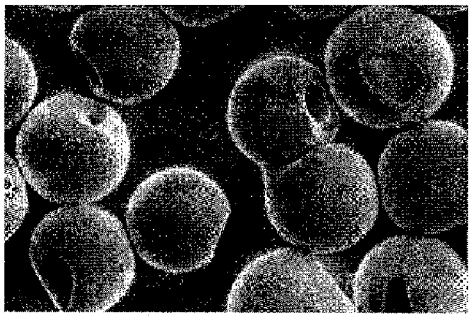
FIG. 1 (*a*) and (*b*) show SEM pictures of porous toners (a) and nonporous toners (b)

The application of porous toner particles in the electrophotographic process will reduce the toner mass in the image area. A toner particle with 50% porosity should require only half as much mass to accomplish the same imaging results. Hence, toner particles having an elevated porosity will lower the cost per page and decrease the stack height of the print as well. The porous toner technology of the present invention provides a thinner image so as to improve the image quality, reduce curl, save fusing energy and feel/look more close to offset printing rather than typical EP printing. In addition, color porous toner of the present invention will narrow the cost gap between color and monochrome toners. Those potentials are expected to be able to expand EP process to broader application areas and promote more business opportunities for our company.

This present invention prepares porous toners by chemical toner technology, particularly, by limited coalescence polymerization process. Porous polymer beads are widely used in various applications, such as chromatographic columns, ion exchange and adsorption resins, drug delivery and painting. The methods to generate pores inside of small polymer beads during polymerization are well studied in polymer science and industry. However, due to the specific requirements for the toner binder materials, such as suitable glass transition, crosslinking density and rheology, the preparation of porous toners through chemical toner process is not straightforward.

In this invention, we obtain the micro size pores inside of toner beads by addition of specific kinds of pore generating compounds during limited coalescence polymerization. The essential properties of the pore generating compounds are: a) good miscibility with monomer mixtures; b) no negative impact on polymerization; c) good precipitant for the obtained polymer: d) low plasticizing effect on the polymer binder and e) capability to be removed easily after polymerization.

The present invention is a modification of the evaporative limited coalescence process described in U.S. Pat. Nos. 4,883,060; 4,965,131; 2,934,530; 3,615,972; 2,932,629 and 4,314,932, the disclosures of which is hereby incorporated by reference.

In the process of the present invention, a pore generating compound, a polymerization initiator and optionally a colorant and a charge control agent are mixed with water-immiscible polymerizable monomers. The organic mixture is dispersed in water containing stabilizer to form an aqueous suspension of droplets that is subjected to high shear to reduce droplet size and achieve narrow size distribution droplets through limited coalescence process. The monomers in the emulsified mixture are polymerized, preferably through the application of heat. However, the monomers are able to polymerize with radiation or polymerize at lower rate even without the application of heat. The water immiscible pore generating compound is then removed so as to produce a suspension of narrow disperse porous polymerized particles. The polymerized particles are isolated from the remainder of the system.

As indicated above, the present invention is applicable to the preparation of polymeric particles from any type of monomer that is capable of being dissolved in a solvent that is immiscible with water and polymerized in the solvent phase. Useful binder monomers include vinyl monomers, such as styrene monomers, and condensation monomers such as esters mixtures thereof. Polymerizable vinyl monomers include styrene, alpha-chlorostyrene, acrylonitrile, methacrylonitrile, methyl methacrylate, vinyl chloride, methyl acrylate, ethyl methacrylate, ethyl acrylate, butyl methacrylate, butyl acrylate, 2-ethylhexyl methacrylate, 2-ethylhexyl acrylate, stearyl methacrylate, vinyl acetate, divinyl benzene, ethylene glycol dimethacrylate, trimethylolpropane triacrylate, trimethylolethane triacrylate, tetramethylolmethane tetracrylate and others.

Particularly useful binder monomers are ones that form styrene polymers of from 40 to 100 percent by weight of styrene monomers and from 0 to 45 percent by weight of one or more alkyl acrylate monomers or alkyl methacrylate monomers. The toner particles can be further crosslinked during polymerization process. Fusible styrene-acrylic copolymers that are covalently lightly cross-linked with a divinyl compound such as divinylbenzene, as disclosed in U.S. Reissue Pat. No. 31,072, are particularly useful. Other kinds of crosslinkers include multi-functional acrylates. Also, especially useful are polyesters of aromatic dicarboxylic acids with one or more aliphatic diols, such as polyesters of isophthalic or terephthalic acid with diols such as ethylene glycol, cyclohexane dimethanol and bisphenols.

Another useful binder polymer composition comprises: a copolymer of (a) at least one vinyl aromatic monomer; (b) at least one second monomer selected from the group consisting of conjugated diene monomers and acrylate monomers selected from the group consisting of alkyl acrylate monomers and alkyl methacrylate monomers.

Yet another useful binder polymer composition comprises:

a) copolymer of a vinyl aromatic monomer; a second monomer selected from the group consisting of conjugated diene monomers or acrylate monomers selected from the group consisting of alkyl acrylate monomers and alkyl methacrylate monomers; and b) the acid form of an amino acid soap which is the salt of an alkyl sarcosine having an alkyl group which contains from about 10 to about 20 carbon atoms. Binder polymer compositions of this type with a third monomer, which is a crosslinking agent, are described in U.S. Pat. No. 5,968,700. Binder polymer compositions of this type without the crosslinker are made in accordance with the process described in U.S. Pat. No. 5,247,034.

Various additives generally present in electrostatographic toner may be added to the polymer prior to dissolution in the solvent or in the dissolution step itself, such as colorants, charge control agents, waxes and lubricants.

Colorants, a pigment or dye, suitable for use in the practice of the present invention are disclosed, for example, in U.S. Reissue Pat. No. 31,072 and in U.S. Pat. Nos. 4,160,644; 4,416,965; 4,414,152 and 2,229,513. Colorants are generally employed in the range of from about 1 to about 30 weight percent on a total toner powder weight basis, and preferably in the range of about 2 to about 15 weight percent. Mixtures of colorants can also be used. Colorants in any form such as dry powder, its aqueous dispersions or wet cake can be used in the present invention. Colorant milled by any methods like media-mill or ball-mill can be used too.

The term "charge control" refers to a propensity of a toner addendum to modify the triboelectric charging properties of the resulting toner. A very wide variety of charge control agents for positive charging toners are available. A large, but lesser number of charge control agents for negative charging toners are also available. Suitable charge control agents are disclosed, for example, in U.S. Pat. Nos. 3,893,935; 4,079,014; 4,323,634; 4,394,430 and British Patents 1,501,065; and 1,420,839. Charge control agents are generally employed in small quantities such as, from about 0.1 to about 5 weight percent based upon the weight of the toner. Additional charge control agents which are useful are described in U.S. Pat. Nos. 4,624,907; 4,814,250; 4,840,864; 4,834,920; 4,683,188 and 4,780,553. Mixtures of charge control agents can also be used.

Any suitable solvent that will dissolve the monomers and miscible with other additives, such as pore generating compound and polymerization initiator, but immiscible with water may be used in the organic mixtures. Examples include chloromethane, dichloromethane, ethyl acetate, propyl acetate, vinyl chloride, MEK, trichloromethane, carbon tetrachloride, ethylene chloride, trichloroethane, toluene, xylene, cyclohexanone, 2-nitropropane and the like. Particularly useful solvents are ethyl acetate, propyl acetate, and dichloromethane for the reason that they are good solvents for many polymers while at the same time they are immiscible with water. Further, its volatility is such that it is readily removed from the discontinuous phase droplets by evaporation.

Pore generating compound can be any organic materials with the following properties: miscibility with monomer mixtures; no negative impact on polymerization; good precipitant for the obtained polymer during polymerization, low plasticizing effect on the polymerized toner particles and capability to be removed easily after polymerization. Pore generating compound be selected from alkanes, such as pentane, hexane, heptane and mineral oil. Preferably, silicone oil is used as the pore generating compounds for the poly(styrene-buty-acrylate) copolymer system.

After polymerization, the polymerized toner particles are treated by further processes, such as evaporation or solvent extraction to remove the pore generating compounds, so as to form micron scale pores inside of the toner particles.

A series of alkanes, such as pentane, hexane, heptane and mineral oil, were chosen as generating compounds and provided the polymer toner particles with a porosity of about 10%. Further investigation indicates silicone oil is the most preferred pore generating compounds for the poly(styrene-buty-acrylate) copolymer system and the polymerized toner particles with more than 20% of porosity were obtained. Toner particles having a porosity of greater than 50 percent were further prepared with various formulations.

The general procedure for the porous polymer beads is as follows:

An aqueous solution is prepared by dissolving a pre-determined amount of poly(methylaminoethylene adipate), which is prepared in-house by conventional condensation polymerization methods, Ludox™ and potassium chromate into distilled water. An organic solution is obtained by mixing styrene, butyl acrylate, divinyl benzene, Akzo 67 and pore generating compound. The organic solution is emulsified with the aqueous solution by Silverson mixer and microfluidizer. The emulsion is then charged into a 3-neck flask equipped with a condenser and a mechanical stirrer. The emulsion is heated to 80° C. for 20 hours, followed by 100° C. for an additional 2 hours. The contents are then cooled to room temperature. Afterward, the suspension is filtered on a glass frit and washed with water several times and dried in a vacuum oven for 2-4 hours. The dried polymer beads are extracted by isopropanol for 12 hours. The extracted polymer beads are isolated by filtration afterwards and maintained in the vacuum oven at 30-40° C. for 16 hours.

The particle properties, such as size, shape and morphology, are evaluated by optical and Scanning Electron Microscope (SEM). The particle size distribution is characterized by Coulter Particle Analyser. The glass transition temperature of polymers is determined by use of a Differential Scanning Calorimeter (DSC). The porosity of the polymer particles is calculated from the ratio of the apparent packing density of the porous beads and solid beads.

All chemicals in the examples discussed herein below, except where the preparation thereof is specifically described, were obtained from Sigma Aldrich, Inc. of Milwaukee, Wis. and were used directly as obtained without purification.

EXAMPLE 1

Formulation

Figure 1B:
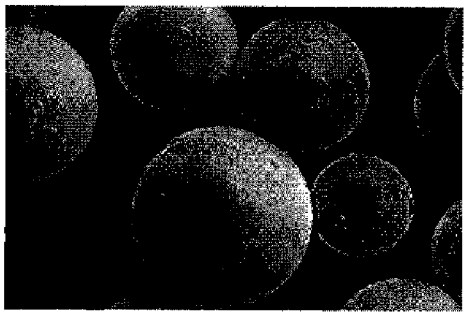

Styrene: 38.5 gram
Butyl acrylate: 11.5 gram
Divinyl benzene: 0.2 gram
Akzo 67 (from Du Pont de Nemours and Company): 1.35 gram
Silicone oil: 51.2 gram
Distilled water: 210 gram
Potassium chromate: 0.05 gram
Poly(methylaminoethylene adipate): 1.89 gram
Ludox™: 4.02 gram The weights of the obtained polymer particles were 93.4 gram and 46.2 gram, respectively, before and after isopropanol extraction. The weight loss percentage during the extraction is 50.5%, which is identical to the ratio of silicone oil in the organic phase. The polymer product was found to be a type of opened hollow spherical beads with an average diameter of 10 micron (FIG. 1 (*a*)). The packing density of the obtained porous beads is 0.34 g/ml, which implies 48.5% porosity compared with the solid beads from Comparative Example 1. The glass transition of the porous beads is 63.7° C.

COMPARATIVE EXAMPLE 1

Formulation

Styrene: 38.5 gram
Butyl acrylate: 11.5 gram
Divinyl benzene: 0.2 gram
Akzo 67: 1.35 gram
Distilled water: 100 gram
Potassium chromate: 0.025 gram
Poly(methylaminoethylene adipate): 0.9 gram
Ludox™: 1.91 gram The weight of the isolated particles is 46.0 gram and maintained constant during IPA extraction. The product is a white spherical solid bead with average diameter of 10 micron (FIG. 1(*b*)). Its packing density is 0.66 g/ml, which is almost double compared with the density of the porous beads in Example 1. Its glass transition temperature is 61.8° C., which is similar to that of the porous beads in Example 1.

Figure 2A:
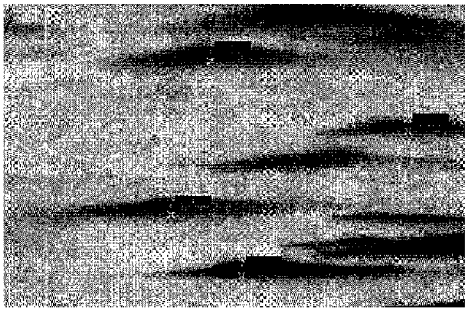
FIG. 2 (*a*) and (*b*) show SEM pictures fused porous toners (a) and fused nonporous toners (b).
Figure 2B:
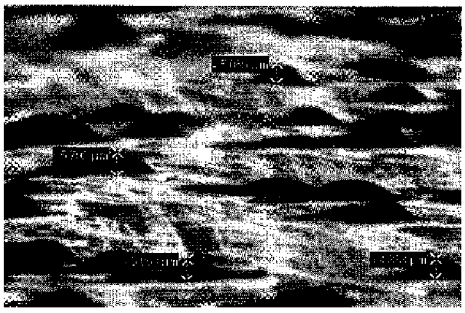

The polymer beads were heated far above their glass transition temperature and fused under pressure. It was measured by SEM that the porous beads in Example 1 have a fused height of 2.5 micron and a fused area of 27 micron, while the solid beads in Comparative Example 1 have a fused height of 5.2 micron and a fused area of 33 micron (FIG. 2). This fusing data demonstrates that the porous beads are able to reduce the image thickness in the print dramatically.

EXAMPLE 2

The carbon black, 3.6 gram of XPB 296 from Degussa AG of Germany, and charge control agent (CCA), 0.25 gram of T77 from Hodogaya Chemical Co., Ltd. of Japan, were added to the organic mixture in Example 1. All other components were the same as Example 1. Black toner particles were obtained through the general polymerization procedure. The weights of the isolated particles were 91.8 gram and 46.7 gram, respectively, before and after isopropanol extraction. The weight loss percentage during the extraction is 49.1%, which is close to the ratio of silicone oil in the organic phase. The polymer product was found to be a type of opened hollow spherical black beads with an average diameter of 10 micron. The packing density of the obtained porous beads is 0.32 g/ml, which implies 51.5% porosity compared with the solid beads.

EXAMPLE 3

The process is similar to Example 2 with a modified formulation.

Formulation

Styrene: 38.5 gram
Butyl acrylate: 11.5 gram

Divinyl benzene: 0.17 gram
Akzo 67: 1.75 gram
Silicone oil: 52.3 gram
Carbon Black (XPB 296): 6 gram
T77: 0.24 gram
Distilled water: 210 gram
Potassium chromate: 0.05 gram
Poly(methylaminoethylene adipate): 1.89 gram
Ludox™: 4.02 gram The isolated black particles weighed 84.3 gram and 42.9 gram, respectively, before and after isopropanol extraction. The weight loss percentage during the extraction is 49.1%, which is close to the ratio of silicone oil in the organic phase. The major toner beads were found to be again a type of opened hollow spherical black beads with average diameter of 9 microns. The packing density of the obtained porous beads is 0.41 g/ml and the calculated porosity is 37.9%.

In conclusion, the present invention demonstrates the preparation of the chemically prepared porous toners based through limited coalescence polymerization process. It is possible to apply the idea of the pore generating compounds into other polymer systems and other chemically prepared toner technology, e.g. polyester through the evaporation limited coalescence process. The application of porous toners provides a potential approach to reduce the cost of the print and improve the print quality.

The invention has been described in detail with particular reference to certain preferred embodiments thereof, but it will be understood that variations and modifications can be effected within the spirit and scope of the invention.

What is claimed:

1. A toner comprising:
a binder resin having a porosity of greater than 20 percent, wherein the binder resin comprises polymers formed from vinyl monomers.

2. The toner of claim of 1 further comprising at least one charge control agent.

3. The toner of claim of 1 further comprising at least one colorant.

4. The toner particles of claim 1 further comprising at least one surface treatment agent.

5. A toner comprising:
a binder resin comprising a styrene-butyl acrylate-divinyl benzene polymer having a porosity of greater than 20 percent.

6. The toner of claim of 5 further comprising at least one charge control agent.

7. The toner of claim of 5 further comprising at least one colorant.

8. The toner of claim 5 further comprising at least one surface treatment agent.

9. A method of manufacturing toner particles comprising:
preparing an organic solution of water-immiscible polymerizable vinyl monomers, a polymerization initiator and a pore generating compound;
preparing a aqueous solution of a stabilizer;
emulsifying the aqueous solution and organic solution to form a mixture;
polymerizing the monomers in the emulsified mixture to form porous polymer beads; and
removing the pore generating compound from the porous polymer beads;
wherein the pore generating compound comprises an alkane or silicone oil which is miscible with the polymerizable vinyl monomers and which is a precipitant for the polymerized monomers.

10. The method of claim 9 wherein the porous polymer beads comprises vinyl polymers of styrene, butyl acrylate and benzene.

11. The method of claim 9 wherein the organic solution further comprises a charge control agent.

12. The method of claim 9 wherein the organic solution further comprises a colorant.

13. The method of claim 9 wherein the organic solution further comprises a lubricant.

14. The method of claim 9 wherein the organic solution further comprises a wax.

15. A method of manufacturing toner particles comprising:
preparing an organic solution of water-immiscible polymerizable vinyl monomers, a polymerization initiator and a pore generating compound;
preparing a aqueous solution of a stabilizer;
emulsifying the aqueous solution and organic solution to form a mixture;
polymerizing the monomers in the emulsified mixture to form porous polymer beads; and
removing the pore generating compound from the porous polymer beads;
wherein the pore generating compound comprises silicone oil which is miscible with the polymerizable vinyl monomers and which is a precipitant for the polymerized monomers.

16. The method of claim 9 wherein the pore generating compound comprises an alkane.

* * * * *